United States Patent [19]

Snider et al.

[11] Patent Number: 4,490,704

[45] Date of Patent: Dec. 25, 1984

[54] THERMALLY RESPONSIVE SWITCHING DEVICE

[75] Inventors: Harold F. Snider; Gerard H. Risacher, both of Mansfield, Ohio

[73] Assignee: Therm-O-Disc, Incorporated, Mansfield, Ohio

[21] Appl. No.: 532,080

[22] Filed: Sep. 14, 1983

[51] Int. Cl.[3] ..... H01H 37/04; H01H 37/52

[52] U.S. Cl. ..... 337/372; 337/112; 337/365; 337/380

[58] Field of Search ..... 337/107, 109, 112, 362, 337/365, 372, 377, 380, 102

[56] References Cited

U.S. PATENT DOCUMENTS 3,430,177 2/1969 Audette ..... 337/365

4,015,229 3/1977 Senor et al. ..... 337/107

*Primary Examiner*—Harold Broome

*Attorney, Agent, or Firm*—Pearne, Gordon, Sessions, McCoy, Granger & Tilberry

[57] ABSTRACT

A thermally responsive switching device suitable for use as a motor protector and the like is disclosed. Such device includes a housing assembly consisting of a thermoplastic base and a shallow drawn metallic cover. The base provides sidewalls extending to a peripheral flange against which a flange on the cover is positioned. The thermoplastic material is deformed inwardly around the cover flange to permanently connect the assembly. The switch includes an elongated bimetal snap element supported at one end on the end of a heater in heat exchange relation therewith. The other end of the heater is connected to an external terminal through an opening in the thermoplastic base. The terminal provides a tubular projection extending through the opening and a plurality of inwardly extending, resilient tabs which are welded to the heater. The resilient tabs resiliently bias the heater toward the terminal to ensure that looseness does not occur if the base material shrinks and to accommodate differential thermal expansion to prevent looseness or excessive stresses in the thermoplastic material. A mounting stud is welded to one end of the snap element and a movable contact is welded to the other end. Reinforcing elements cooperate with the stud and the movable contact to sandwich the material of the bimetal therebetween to minimize fatigue inducing stress concentrations.

10 Claims, 5 Drawing Figures

THERMALLY RESPONSIVE SWITCHING DEVICE

BACKGROUND ON THE INVENTION

This invention relates generally to switches which are thermally responsive, and more particularly to a novel and improved switch adapted for use as a motor protector and the like.

PRIOR ART

Electrical apparatus, such as motors, generators, transformers, and the like, are often provided with protective devices to prevent overcurrent and overtemperature conditions. Such protector devices are generally mounted within the apparatus being protected so that they can respond to the existing temperature conditions, and are provided with current-responsive heater means which cause the device to also respond to current conditions. Further, such protector devices must, in many instances, be quite small so that they can be mounted within the apparatus itself. Examples of prior art devices of this type are illustrated in U.S. Pat. Nos. 3,430,177 and 4,015,229.

SUMMARY OF THE INVENTION

There are a number of aspects to the present invention. In accordance with one important aspect of this invention, a novel and improved housing assembly is provided, including a body formed of electrically non-conductive material and a metallic cover. The switch structure is mounted in a switch cavity defined by such assembly in such a way that insulating gaskets and the like are not required. The body assembly is structured so that the body assembly parts are easily and reliably permanently connected. Further, the assembly is structured so that the switch cavity is effectively sealed.

In accordance with another important aspect of this invention, a novel and improved switch and terminal structure is provided. The heater and the bimetal blade assembly are secured in the non-conductive body by terminal means which provide a resilient mounting system so that shrinkage of the non-conductive body does not cause any looseness of the assembly and so that differential thermal expansion between the metallic and non-metallic parts does not cause damaging stresses on the components. Further, the switch structure is arranged to minimize any tendency for fatigue failures to occur.

These and other aspects of this invention are illustrated in the accompanying drawings, and are more fully described in the following specification.

DETAILED DESCRIPTION OF THE PREFERRED EMBODIMENT

Figure 1:
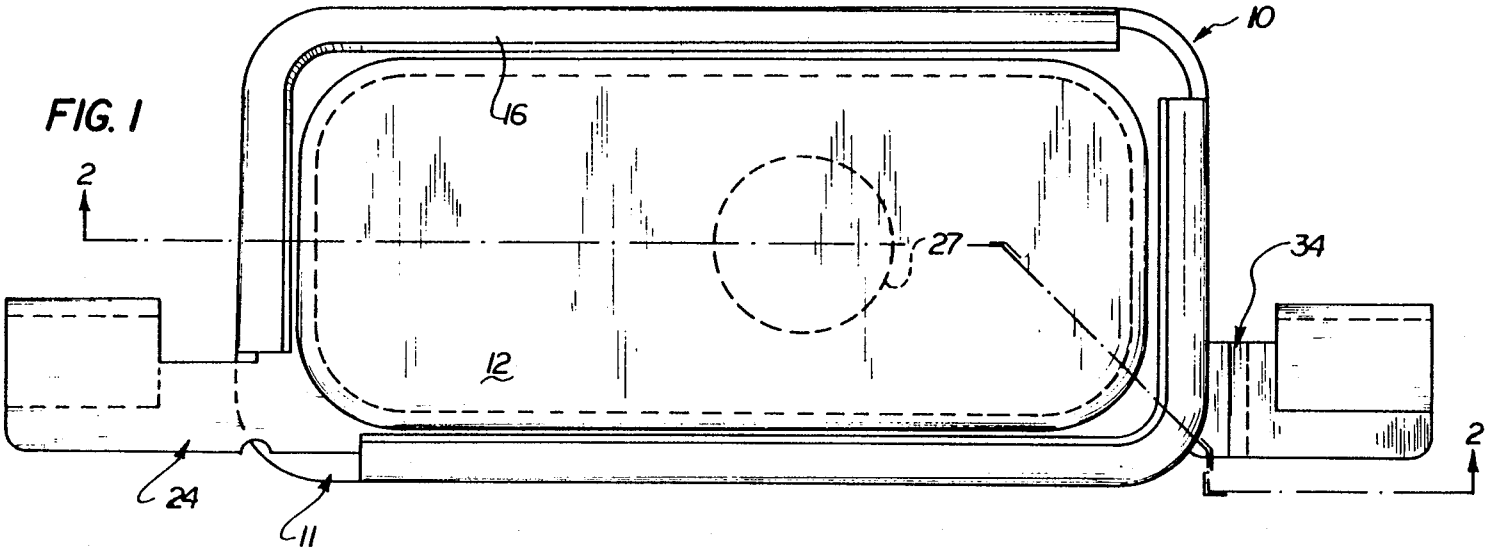
FIG. 1 is a plan view illustrating a thermally responsive switch incorporating the present invention.
Figure 2:
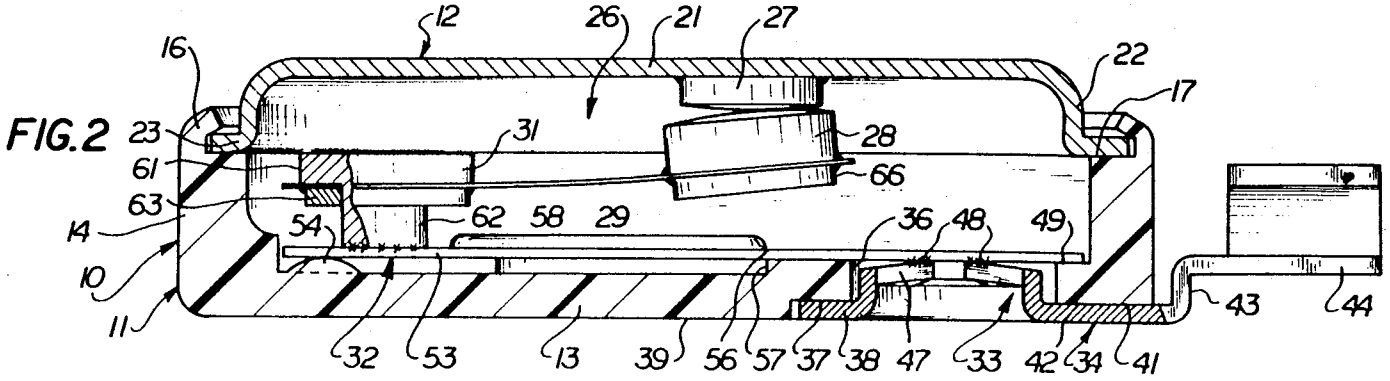
FIG. 2 is a staggered cross section, taken generally along line 2—2 of FIG. 1, illustrating the internal structure of the device.
Figure 3:
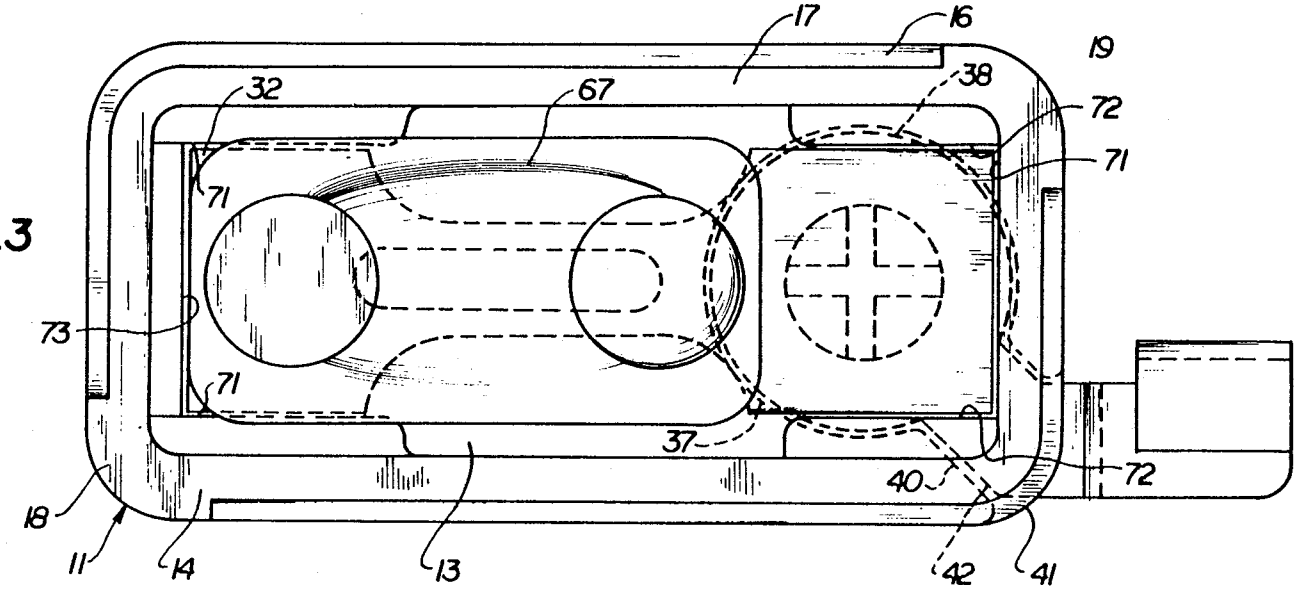
FIG. 3 is a plan view similar to FIG. 1, with the cover removed to illustrate the snap element.

The illustrated embodiment provides a housing assembly 10 consisting of a molded thermoplastic base 11 and a drawn metallic cup-like cover 12. As best illustrated in FIG. 2, the base provides an end wall 13 and upstanding sidewalls 14. In the illustrated embodiment, the base is generally rectangular in shape, as illustrated in FIGS. 1 and 3 and, with the sidewalls 11, provides a relatively shallow cup-shaped element. The sidewalls 14, prior to assembly, extend upwardly to an upstanding flange 16 of reduced thickness which extends vertically upward from a peripheral mounting surface or laterally extending shoulder 17. As illustrated in FIGS. 1 and 3, the upstanding flange 16 is interrupted at diagonally opposed corners 18 and 19 for reasons explained below. However, the shoulder 17 extends completely around the sidewall 14.

The metallic cover is also generally rectangular in shape and is formed with a relatively shallow draw so that it provides an end wall 21 and sidewalls 22 which extend from the end wall to an outwardly extending flange 23. The flange 23 is proportioned to fit against the shoulder 17 within the upstanding flange 16, and after the cover is positioned against the shoulder 17, the upstanding flange 16 is deformed inwardly over the flange 23, as illustrated in FIGS. 1 and 2, to permanently connect the cover 12 and the base 11. Although the upstanding flange 16 is illustrated as bent over the flange 17 of the cover along its entire length, it is not necessary in all cases to deform the flange 16 along its entire length but merely to deform it over the cover flange 17 at spaced intervals around the cover flange.

The cover 12 is formed with an integral terminal extension 24, which, in the illustrated embodiment, extends out along the corner 18, where the upstanding flange 16 is interrupted. In some instances where it is desired to provide both terminals of the device at the same end, the cover is installed so that the terminal 24 extends out along the corner 19 instead of the corner 18.

The components of the switch are mounted within the switch cavity 26 defined by the base 11 and cover 12. Such switch components include a fixed contact 27 welded to the end wall 21 of the cover 12. A movable contact 28 is mounted on the free end of a bimetal snap element 29, which is supported at its other end by a weld stud 31. The weld stud is, in turn, secured by welding to the free end of a heater 32, which extends lengthwise of the switch cavity 26 substantially adjacent to the end wall 13. The opposite end of the heater is welded to a projecting portion 33 of a second terminal 34. The two terminals 24 and 34 provide the structure for connecting the switch to the external circuit which is to be protected by the device.

The end wall 13 is formed with an opening 36 therethrough proportioned to receive the projecting portion 33 of the terminal, and is recessed at 37 along its exterior surface so that a circular flange 38 formed on the second terminal 34 engages the inner wall of the recess 37 completely around the opening 36 and has its exterior surface flush with the principal outer surface 39 of the end wall 13. Such recess is also provided with a diagonal extension 40 which extends out along the associated corner at 41 to receive a diagonal portion 42 of the terminal 34. Beyond the diagonal portion of the terminal 34 and beyond the edge of the body assembly, the terminal is formed with an upstanding offset 43, and beyond the offset 43 is formed with an end portion 44 structured to provide a connection with a suitable electrical conductor. The shape of the recess 37, including its extension 40, not only locates the terminal 34, but also orients it with respect to the base member 11.

Figure 5:
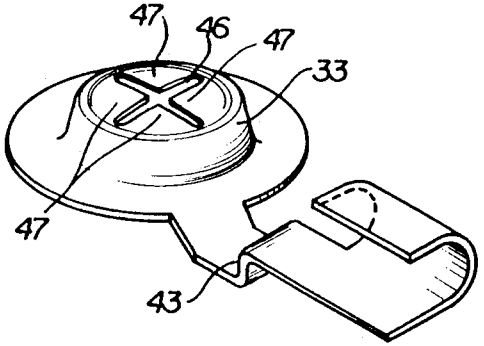
FIG. 5 is a perspective view, illustrating the structure of the terminal which connects to one end of the heater blade and secures the heater blade in the body assembly.

The projection 33 is formed by stamping the metal of the terminal 34 and provides an end wall formed with cross-cuts 46, as best illustrated in FIG. 5, so that the end wall of the projection 33 provides four symmetrically arranged, inwardly extending projections 47. These projections are welded at their inner extremities to the lower surface of the mounting end of the heater 32. Prior to the welding operation, the projections 48 are coplanar and extend radially with respect to the projection 33. However, during the welding operation, they are deformed from their unstressed condition, and are held in such deflected condition, best illustrated in FIG. 2, by the weld connections at 48 with the heater 32. Therefore, the projections 47 function as springs urging the adjacent end of the heater 32 toward the surface 49 of the end wall 13 around the opening 36 and also urging the flange 38 toward the inner surface of the recess around the opening 36.

With this spring type connection, proper positioning and gripping of the mounting end of the heater 32 is ensured even if the material of the end wall shrinks over a period of time. Further, such spring-type connection accommodates differential thermal expansion between the metallic and non-metallic parts, which tends to create looseness or excessive stresses in the mounting structure. When differential thermal expansion between the metallic and non-metallic parts tends to cause excessive clamping forces, the projections 47 are deflected an additional amount and prevent damaging loads on the material of the base 11 around the opening 36.

Figure 4:
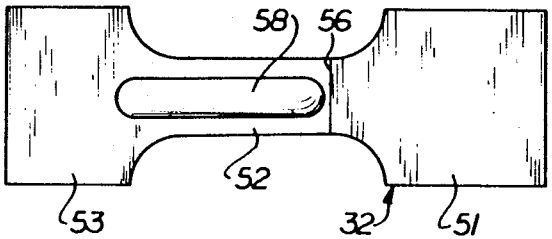
FIG. 4 is a plan view of the heater blade.

The heater 32 is preferably shaped substantially as indicated in FIG. 4 and provides an enlarged mounting end 51 and a heating portion 52 which is notched out to decrease the cross section of the heating portion as it extends from the mounting portion 51 to an enlarged opposite end at 53. The heating portion is sized by the proper selection of the width thereof, the thickness thereof, and the material used to form the heater to provide the desired heating characteristics with respect to current flowing through the heater. The free end 53 of the heater engages a projection 54 formed in the base, which locates such free end when the heater is mounted. Prior to the mounting of the heater, it is preferably formed with a shallow bend at 56 to ensure that the free end engages the projection 54. During the welding operation, which clamps the mounting end 51 against the surface 49 around the opening 36, the engagement between the free end 53 of the heater and the projection 54 deflects the heater from its unstressed position, straightening the bend, and ensures that sufficient pressure is developed against the projection to maintain engagement during the operation of the switch. The end wall is recessed from a location 57 substantially adjacent to the bend so that the heater portion 52 is spaced from the end wall 13. A stiffening rib 58 is preferably formed centrally along the heating portion 52 so that the deflection caused by the engagement with the projection 54 occurs substantially at the bend 56. Such stiffening rib, however, does not project beyond the bend at 56, so that the deflection can occur at such point.

The weld stud 31 is provided with a head portion 61 and a shank 62 which extends through an opening formed in the snap element 29 with a close fit. Positioned around the shank portion is a back-up ring 63 which is welded to the side of the snap element opposite the head portion 61 to sandwich the bimetal of the snap element 29 therebetween. The shank portion 62 is welded to the upper surface of the heater to complete the mounting of the bimetal snap element 29 on the free end of the heater 32.

Welded to the side of the bimetal snap element opposite the movable contact 28 is another back-up element or disc 66. The disc between the ends thereof is formed with a curvature or a shallow dished shape, as illustrated by the shade lines 67 in FIG. 3. This shallow dished shape gives the snap acting characteristics to the snap element so that the movable contact 28 is moved into engagement with the fixed contact 27 when the snap element reaches a first temperature and snaps through to an opposite position of curvature, moving the movable contact 28 away from the fixed contact 27 upon reaching another temperature. Because the snap element is relatively short, the dished portion of the snap element extends beyond the adjacent extremities of the head portion 61 of the weld stud 31 and the movable contact 28, as illustrated by the shade lines in FIG. 3. The provision of the back-up members 63 and 66 tends to spread the stresses created within the snap element during its snap operation, tending to reduce fatigue failures after repeated cycling. Therefore, when the switch must be capable of large numbers of opening and closing cycles without failure, the provision of these two reinforcing or back-up members operates to extend the life of the disc by preventing cracking-type fatigue failure in the snap element. In some instances, it has been established that the fatigue life of a snap element of this type can be increased by $2\frac{1}{2}$ times when these back-up elements are provided.

Lateral and longitudinal positioning of the heater 32 is provided by opposed pairs of projections 71 and 72 molded into the base at the two ends of the heater and end walls 73 formed in the base. Such walls ensure proper positioning of the heater and, in turn, the snap element within the base prior to and during the welding of the heater to the second terminal 34.

Preferably, the switch structure is assembled as follows. The weld stud 31 and back-up ring 63 are welded to one end of the snap element, and the movable contact 28 and the back-up disc 66 are welded to the other end thereof prior to forming the shallow dish shape in the snap element. After such welding operation, the snap element is bumped to produce the desired shallow curvature which produces the snap action and temperature response. Thereafter, the shank 62 of the weld stud is welded to one end of the heater 32 to form a complete subassembly. The heater is then positioned in the base and welded to the terminal 34, a discussed above, completing the base subassembly of the entire device.

The fixed contact is then welded on the cover 12 to produce the cover subassembly, which is then installed against the shoulder 17, and the upstanding flange is deformed down against the upper side of the flange 23 to complete the assembly operation. A suitable sealant and adhesive, such as epoxy, is then applied around the cover at the interface between the flange 23 and shoulder 17. Similarly, epoxy or other suitable sealant adhesive can be applied to the interface between the surface 49 around the opening 36 and the heater so that the switch chamber is virtually hermetically sealed against contamination.

Calibration of the assembled device is accomplished by bending the end wall 21 of the cover in to "pull in" the snap element and to cause it to snap to the contact-open position at the desired temperature condition at which calibrated operation is required. Because the cover 12 is formed with sidewalls 22, the cover is relatively stiff, and such calibration bending of the end wall 21 does not cause distortion of the flange 26.

With the illustrated embodiment of this invention, a very small device can be produced reliably and economically, and the structure is susceptible to automated assembly operations. Further, because the housing assembly is formed in part by a non-metallic electrically non-conductive material, it is not necessary to provide separate gaskets for insulating elements to electrically isolate the various parts of the switch. Further, such non-metallic base is less heat-conductive, so that the heat generated by current flow through the heater and the snap element is not dissipated as much as it would be if the adjacent housing assembly were metal. Consequently, more rapid response to current flow is achieved for a given heater and snap element. Additionally, because the snap element is supported against fatigue failure, the device is capable of many cycles of operation without failure. Still further, the use of a resilient mounting connection between the second terminal and the heater ensures that neither looseness nor excessive damaging stress conditions occur when the device is used.

Although the preferred embodiment of this invention has been shown and described, it should be understood that various modifications and rearrangements of the parts may be resorted to without departing from the scope of the invention as disclosed and claimed herein.

What is claimed is:

1. A thermally responsive switch comprising a housing assembly including:

a cup-shaped body member formed of non-metallic electrically insulating material providing an end wall with an opening therethrough and perpendicularly extending sidewalls; and a cover connected to said sidewalls and cooperating with said body to define a switch cavity, said sidewalls providing a shoulder extending around said cavity and reduced thickness wall extensions extending beyond said flanges.

said cover providing a peripheral flange seated against said shoulder, said sidewalls extensions being deformed around said peripheral flange securing said peripheral flange against said shoulder, and switch means mounted on said housing assembly within said cavity, said switch means including an elongated heater connected at one end through said opening to an external terminal, an elongated bimetal snap element mounted at one end thereof on the other end of said heater and overlying said heater in heat exchange relationship therewith, a movable contact carried by the other end of said snap element, and a fixed contact mounted on said cover, said snap element operating in response to predetermined temperatures to move said movable contact into and out of engagement with said fixed contact with snap action.

2. A thermally responsive switch as set forth in claim 1, wherein said end wall provides an internal planar surface around said opening within said cavity and an external planar surface around said opening, said connection between said one end of said heater and said terminal providing a spring bias resiliently urging said one end of said heater against said internal planar surface and said terminal against said external planar surface and preventing looseness and damaging stresses in said end wall caused by shrinkage and differential thermal expansion.

3. A thermally responsive switch as set forth in claim 2, wherein one of said terminal and said heater is formed with a cup-shaped tubular projection having an end providing a plurality of inwardly extending mounting tabs, said tabs being welded adjacent their ends to the other of said terminal and heater and being deflected from their unstressed condition to provide said spring bias.

4. A thermally responsive switch as set forth in claim 3, wherein said tubular projection is provided on said terminal and said tabs are welded to said heater.

5. A thermally responsive switch as set forth in claim 1, wherein said snap element is secured to said heater by a weld stud having a head welded to the side of said snap element remote from said heater and a reduced diameter shank extending through an opening in said snap element, and a back-up ring welded to said snap element around said shank on the side of said snap element remote from said head, said shank being welded to said other end of said heater and spacing said back-up ring and snap element from said heater, said snap element providing a shallow dish shape extending at its periphery partially around said head, said head and back-up ring sandwiching said snap element therebetween and resisting stress concentrations tending to fracture said bimetal.

6. A thermally responsive switch as set forth in claim 5, wherein a reinforcing disc is welded to said snap element in alignment with said movable contact on the side of said snap element remote therefrom, said shallow dish shape extending at least partially around the periphery of said movable contact and back-up disc, said movable contact and said back-up disc sandwiching said snap element therebetween and resisting stress concentrations tending to fracture said bimetal.

7. A thermally responsive device comprising a body formed of non-metallic electrically insulating material formed with a wall having an opening therethrough, said wall providing surfaces at each end of said opening, said body defining at least part of a switch chamber, a metallic switch element positioned against the surface at the end of said opening adjacent to said switch chamber, a metallic terminal positioned against said surface on the opposite end of said opening, one of said switch elements and said terminal providing a tubular projection having an end providing a plurality of inwardly extending mounting tabs, said tabs being welded adjacent their inner ends to the other of said switch element and terminal and being deflected from their unstressed condition to provide a spring bias resiliently urging said switch element and terminal toward each other into engagement with the associated of said surfaces to prevent looseness therebetween and being further deformable to prevent damaging stresses in said wall caused by differential thermal expansion.

8. A thermally responsive switch comprising an elongated bimetal snap element movable with snap action between two positions of stability, a mounting stud providing an enlarged head and a shark extending therefrom, said head welded to one side of said snap element adjacent to one end thereof, a reinforcing element having a shape substantially the same as said head welded to the other side of said snap element adjacent to said head, said head and reinforcing element cooperating to grip opposite sides of said snap element adjacent to the peripheries thereof, support means, said shank means connected to said support means providing the mounting of said snap element, said snap element providing a shallow dish shape extending at its periphery partially around said head and reinforcing element and causing said snap movement of said snap element, said head and reinforcing element sandwiching said snap element therebetween and resisting stress concentrations tending to fracture said bimetal.

9. A thermally responsive switch as set forth in claim 8, wherein said snap element is provided with an opening therein through which said shank extends, and said reinforcing element is a ring extending around said shank.

10. A thermally responsive switch as set forth in claim 8, wherein a movable contact is welded to the other end of said snap element and a second reinforcing element is welded to said snap element in alignment with said movable contact on the side of said snap element opposite said movable contact, said shallow dish shape extending at its periphery partially around said movable contact and said second reinforcing element, said movable contact and said second reinforcing element sandwiching said snap element therebetween and resisting stress concentrations tending to fracture said bimetal.

* * * * *